United States Patent [19]

Williamson

[11] 4,399,668

[45] Aug. 23, 1983

[54] INDIVIDUAL BEVERAGE COOLER

[76] Inventor: Alma J. Williamson, 28167 E. Duluth, Mt. Clemens, Mich. 48045

[21] Appl. No.: 303,113

[22] Filed: Sep. 17, 1981

[51] Int. Cl.[3] ..... F25D 3/08

[52] U.S. Cl. ..... 62/457; 62/372; 62/530; 215/13 R; 220/85 H; 229/1.5 H

[58] Field of Search ..... 215/13 R; 62/530, 457, 62/372; 220/85 H; 229/1.5 H

[56] References Cited

U.S. PATENT DOCUMENTS

| | | | |
|---|---|---|---|
| D. 159,535 | 8/1950 | Reineke . | |
| 2,058,915 | 2/1935 | Scholl . | |
| 2,081,409 | 5/1937 | Rush | 215/13 R |
| 2,263,122 | 11/1941 | DeHaven . | |
| 2,419,830 | 4/1947 | Freeman . | |
| 2,464,069 | 3/1949 | Benson . | |
| 2,700,492 | 1/1955 | Baetzing . | |
| 2,974,814 | 3/1961 | Parsons et al. . | |
| 3,092,277 | 6/1963 | Brim . | |
| 3,910,328 | 10/1975 | Marcoux . | |
| 4,181,765 | 1/1980 | Harmony | 215/13 R |
| 4,183,226 | 1/1980 | Moore | 62/530 X |
| 4,196,817 | 4/1980 | Moser . | |
| 4,197,890 | 4/1980 | Simko . | |
| 4,228,908 | 10/1980 | Tweeton . | |
| 4,324,111 | 4/1982 | Edwards | 62/530 X |
| 4,344,303 | 8/1982 | Kelly, Jr. | 215/13 R |

*Primary Examiner*—Lloyd L. King

*Attorney, Agent, or Firm*—Burton, Parker & Schramm

[57] ABSTRACT

A flexible, multilayer thermal wrap for beverage containers. The wrap has an inner coolant layer for wrapping about the container which conforms to the container's shape and leaves an opening at the container's top to expose the pouring end. The coolant layer is externally surrounded by an insulative layer. The insulative layer is externally surrounded by a protective layer. Fasteners are provided for securing the covering about a container.

5 Claims, 9 Drawing Figures

INDIVIDUAL BEVERAGE COOLER

DESCRIPTION

FIELD OF INVENTION

My invention is a thermal wrap for beverage containers designed to provide cool beverages when desired by the consumer.

BACKGROUND OF THE INVENTION

At times, when I intend to leave the house to go out into the yard or engage in other activities, I have longed to be able to carry a cool container of beverage with me for later use. At other times I found that when sitting in the home or backyard that my beverages tend to become undesirably warm before I have finished drinking.

I feel that there are many people like myself who have a need for a method of conveniently carrying a cool, refreshing beverage when engaged in activities which make returning to a refrigerator inconvenient. Other people, like myself, who drink their beverages slowly, need a means for keeping their beverages from becoming undesirably warm before they have finished consuming the beverage.

SUMMARY OF THE INVENTION

My invention allows physically active people such as joggers, hikers, walkers, bicyclers; those who go to drive-in movies, picnics, etc.; and those who are simply slow drinkers, to enjoy a cool beverage that may be conveniently carried without the inconvenience of returning to refrigerators, stores, or bulky coolers. My invention is a covering for a beverage container, one embodiment of which includes in combination:

- a flexible multilayer wrapper adapted to encircle a beverage container, conform to the essential shape of the container, and leave an opening at its top to expose the pouring end thereof;
- said wrapper having an inner coolant layer externally surrounded by an insulative layer which in turn is externally surrounded by a protective layer; and
- means for securing the aforesaid multilayer wrapper in wrapped relation about the container.

Preferably the flexible coolant layer is sealed. I have found that such a coolant layer avoids problems of melting ice and water resulting therefrom. And furthermore provides the convenience of having a re-freezable coolant which may be placed in the freezer after use and taken from the freezer when needed for use.

Because all the materials are flexible, the covering may be laid flat and stacked or hung on a wall, taking up very little space, so that storage is convenient. I have found that such a covering may be easily personalized with appliques on the jacket so that confusion as to the ownership or contents of the covering is minimized. Furthermore, I have found that coverings may be provided with handles which may be conveniently slipped over the handlebars of a bicycle for bikers and allow for easier handling of the beverage container. Moreover, I have found that even when the covering has not been precooled or has not been inserted in the individual beverage cooler, that the individual beverage cooler has insulative properties which enable the user to keep beverages cool, although for not as long a period of time.

DESCRIPTION OF THE PREFERRED EMBODIMENTS

Figure 1:
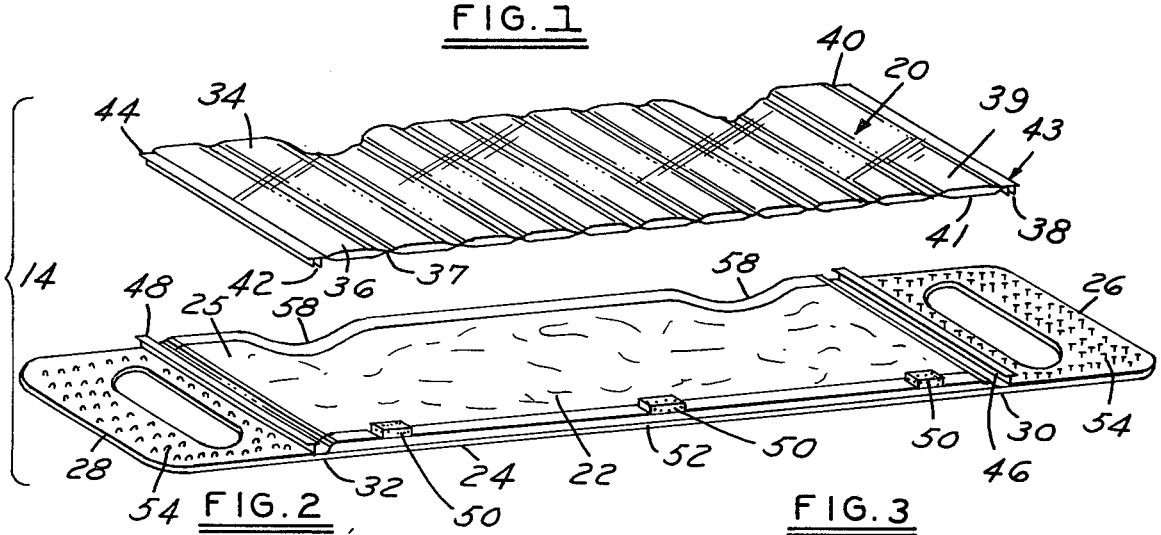
FIG. 1 is a partially exploded view of an individual beverage container covering.

The invention includes a covering 14 for a beverage container 16 which can be used to lower the temperature of the beverage in the container 16, to maintain the temperature of the beverage in the container 16, or to moderate the temperature of the beverage in the container 16. The covering 14 may include a flexible coolant layer 20 dimensioned to be wrapped about the beverage container 16 so as to conform to the shape of the container 16.

The covering 14 may also include a flexible insulative fabric 22 and a protective layer 24 such as a jacket attached to the insulative fabric 22. Generally, the insulative layer 22 may be any insulative material such as nonthermal conductors and thermal reflectors. Examples include resilient and nonresilient, open and closed cell foam regulators, with or without their own protective sheath 25 which sheath 25 is separate and distinct from the protective layer 24 of the covering 14. Materials which may be used are resilient sponge, rigid foam, plastic insulation, which is flat, or open-celled or ribbed, and the like. The insulation may be a solid, continuous piece or may be in segments. See FIGS. 1, 4, 5, 6, 7, 8, and 9.

In a preferred embodiment, as shown in FIG. 1, the covering 14 is essentially rectangular, having a first handle 26 and a second handle 28 attached to the covering 14 at a first end 30 and a second end 32 respectively. In particular, the first handle 26 and the second handle 28 are preferably attached to that portion of the covering 14 which includes the jacket 24 and the insulative fabric 22. The coolant layer 20 is preferably a rectangular, hermetically sealed container, preferably made from a heat sealable plastic and contains a coolant 34 such as BLUE ICE, a trademark of the DIVAJEX Company for a nontoxic refreezable coolant. The coolant layer 20 preferably has discrete compartments 36 of coolant 34. This compartmentalization of the coolant layer 20 provides a more even distribution of coolant 34 and avoids coolant 34 collection at one end of the coolant layer 20. Compartmentalization can be effected with a sealing means such as heat or glue for forming a seal 37 whereby one wall 39 of the coolant layer 20 is sealed to the other wall 41 of the coolant layer 20.

The coolant layer may be attached to the jacket 24-insulative fabric 22 combination-by a fastener 43 such as glue, stitching, velcro, snaplocks, zippers, ziplocks and the like. As shown in FIG. 1, a first ziplock 38 at a first end 40 of the coolant layer 20, and a second ziplock 42 at a second end 44 of the coolant layer 20, wherein the first ziplock 38 is matable with a third ziplock 46 located at the first end 30 of the covering 14 and the second ziplock 42 at the second end of the coolant layer 20 is matable with a fourth ziplock 48 located at the second end 32 of the covering 14.

The covering 14 may also have one or more container rests 50 attached near the bottom 52 of the covering 14, upon which the lower portion of the container 16 may rest, to help keep the container 16 from slipping through the covering 14. Preferably these rests 50 will be large enough to engage at least a portion of the container's bottom and rigid enough to aid in keeping the container 16 from slipping through the covering 14, and may be made from plastic or other material.

Figure 2:
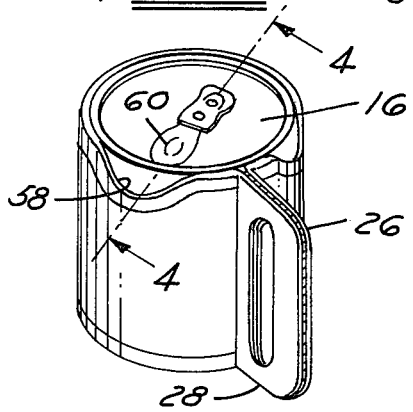
FIG. 2 is a perspective view of an individual beverage container covering, having a handle, and wrapped about a beverage container.

The first handle 26 and the second handle 28 may have fasteners 54 from mating the first handle 26 with the second handle 28. These fasteners 54 serve to keep the covering 14 in place once the covering 14 has been placed about the container 16 as shown in FIG. 2. Preferably, each handle 26 and 28 will have a layer of velcro affixed thereto securing handle 26 to handle 28 when the covering 14 is in place about a container 16.

Where the covering 14 is handleless, fastener 54 may be applied to the first end 30 of the covering which are matable with fasteners 54 applied to the second end 32 of the covering 14. Whether the embodiment has handles or not, fasteners such as velcro, button and hole, snaps, zippers, ziplocks, and the like, may be used.

Preferably, the top of the covering 56 will have scallops 58 so that when the covering 14 is wrapped about the container 16, the pouring spout 60 of the container 16 will be aligned with the scallop 58 so that one may drink from the container without one's lips contacting the covering 14, as shown in FIGS. 1, 2, 3, 4, 7 and 8.

Figure 7:
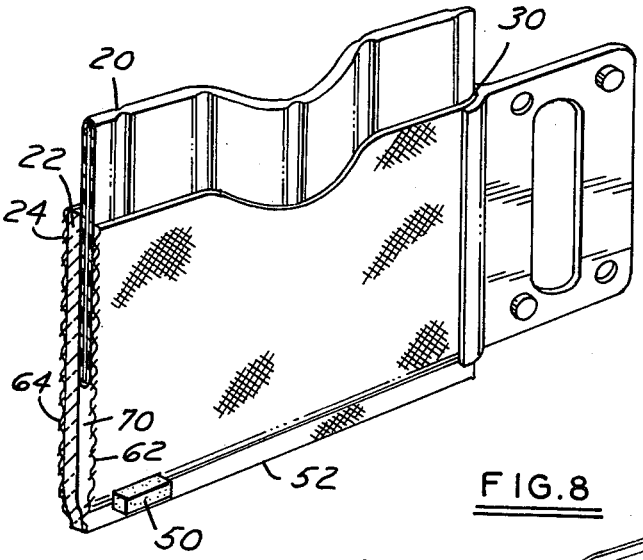
FIG. 7 is an exploded fragmentary cross-sectional view of an individual beverage container covering.
Figure 8:
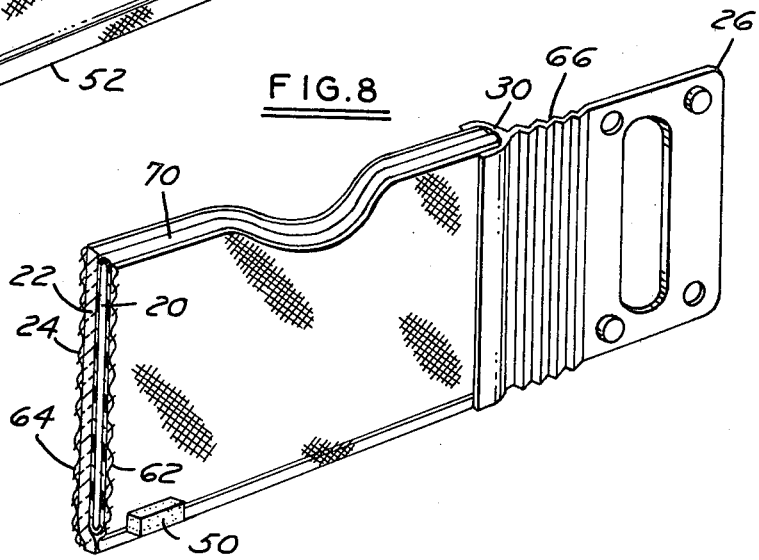
FIG. 8 is a fragmentary view of an individual beverage container covering having a handle elastically attached.
Figure 9:
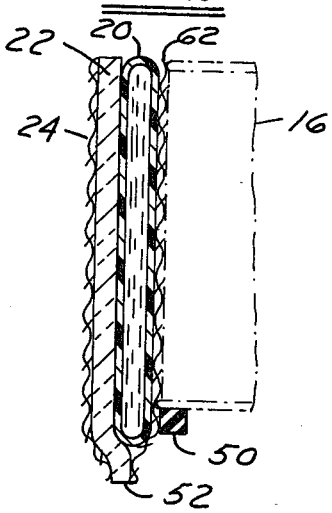
FIG. 9 is a cross-sectional fragmentary view of an individual beverage container covering with a bottom support for a beverage container.

In an alternative embodiment, the covering may include a jacket 24, a flexible insulative fabric 22, a containing layer 62 attached to these so as to form an envelope as shown in FIGS. 7, 8 and 9, with the coolant layer 20 sandwiched between the material 62 and the insulative fabric 22. Preferably, this embodiment will have a first handle 26 and a second handle 28, but need not.

Alternatively, the first end 30 of an embodiment may be attached to the first handle 26 by a resilient connector 66. The resilient connector 66 allows the cover to be held in place about the beverage container 16 by the tension created when the resilient connector 66 is stretched about the container 16.

Preferably, the containing layer 62 used to form the envelope 64 will be as thin as possible to allow for maximum heat transfer from the coolant layer 20 to the container 16. This containing layer 62 may be made from a material 62 such as rayon, cotton, plastic fibered cloth, and the like.

In operation, the coolant layer 20 is preferably placed within a refrigeration device (not shown) and cooled or frozen. When needed, the coolant layer 20 is removed from the refrigeration device and is preferably attached to the jacket 24-insulative fabric 22 combination, as shown in FIG. 1, unless, of course, the covering 14 is of the envelope type as shown in FIGS. 7, 8 and 9. As shown in FIG. 1, the first ziplock 38 of the coolant layer 20 is aligned with and attached to the third ziplock 46 of the jacket 24-insulative fabric 22 combination. The second ziplock 42 of the coolant layer 20 is aligned with and attached to the fourth ziplock 48 of the jacket 24-insulative fabric 22 combination.

Figure 3:
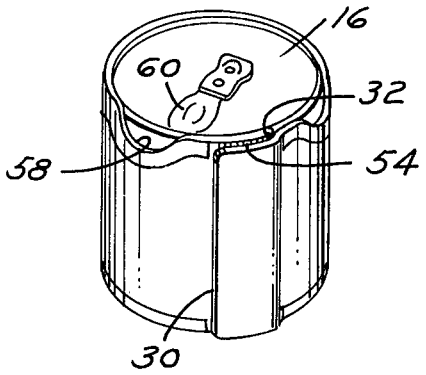
FIG. 3 is a perspective view of a handleless individual beverage container covering wrapped about a beverage container.
Figure 4:
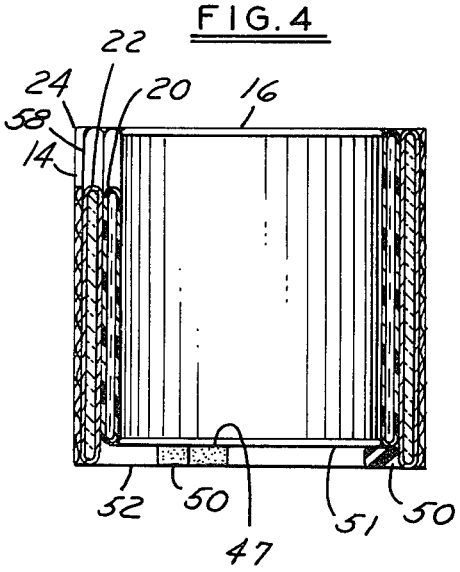
FIG. 4 is a fragmentary cross-sectional view of the beverage container covering taken along line 4—4 of FIG. 2.
Figure 5:
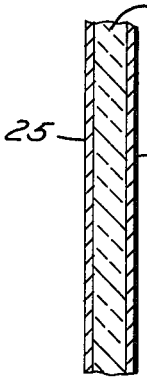
FIG. 5 is a fragmentary cross-sectional view of an insulative flexible fabric.
Figure 6:
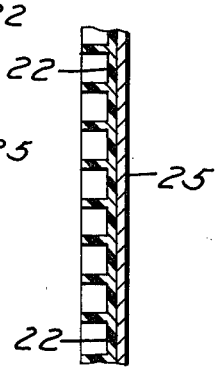
FIG. 6 is a fragmentary cross-sectional view of a plastic insulative flexible fabric.

The container 16 is placed in the covering 14 so that the bottom 51 of the container 16 abuts the top 47 of the supporter rest 50. The covering 14 is then wrapped about the container 16 as shown in FIGS. 2, 3, and 4, with the coolant layer 20 forming the inner layer in closest proximity to the container 16, the insulative layer 22 exterior to and surrounding the coolant layer 20, and the protective layer 24 exterior to and surrounding the insulative layer 22. Preferably, the pouring spout 60 of the beverage container 16 should be aligned with the scallop 58 of the covering 14 as shown in FIGS. 2 and 3, so that when one wishes to drink from the container 16, one may do so without having one's lips touch the covering 14 and the fasteners 54 for the covering 14 secured. Thus, when the covering 14 is in place, the container will be covered and supported as shown in FIGS. 2, 3 and 4.

When using an envelope type covering as shown in FIGS. 7, 8 and 9, one removes the coolant layer 20 from a refrigeration device (not shown) and inserts the coolant layer 20 into the envelope 64 through the envelope opening 70 formed by the jacket 24-flexible insulative fabric 22 combination on the one side, and the containing layer 62 on the other. This covering 14 should be wrapped about the container 16 as described above so that the coolant layer 20 is as close in proximity to the container 16 as possible.

In all the embodiments the first end 30 and the second end 32 of the covering 14 should preferably be fastened with fasteners 54 contained thereon. With those coverings 14 having a first handle 26 and a second handle 28, the fasteners 54 are preferably contained in the handles and should be secured. With those coverings 14 having no handles, the fasteners 59 should be proximate the first end 30 and second end 32 of the covering 14 and should be fastened when the covering 14 is in place about the container 16.

Generally, the covering 14 should be sized so that when placed about the container 16 there is a snug fit. A snug fit provides maximum effectiveness of the covering 14 while keeping the container 16 in place.

I claim:

1. A covering for a beverage container, comprising, in combination:

a flexible multilayer wrapped adapted to encircle a beverage container, conform to the essential shape of the container, and leave an opening at its top to expose the pouring end thereof;

said wrapper having an inner coolant layer externally surrounded by an insulative layer which in turn is externally surrounded by a protective layer;

handles at opposite ends of the wrapper which are matable when the wrapper is covering a beverage container; and means for securing the aforesaid multilayer wrapper in wrapped relation about the container.

2. The multilayer wrapper of claim 1 further comprising:

a containing layer forming one side of an envelope; wherein the protective layer is the other side of the envelope; and the coolant layer and the insulative layer form the contents of the envelope.

3. The wrapper of claim 2 further comprising a container rest proximate the wrapper bottom and attached thereto, for contacting the bottom of a container when it is encircled by the wrapper.

4. The wrapper of claim 2 further comprising at least two container rests proximate the wrapper bottom and attached thereto, for contacting the bottom of a container when it is encircled by the wrapper.

5. The wrapper of claim 3 wherein the coolant layer is a package having compartments containing coolant.

* * * * *